US008228182B2

(12) United States Patent
Orsini et al.

(10) Patent No.: US 8,228,182 B2
(45) Date of Patent: Jul. 24, 2012

(54) SELF-TESTING NOTIFICATION APPLIANCE

(75) Inventors: Todd F. Orsini, Sterling, MA (US); Anthony J. Capowski, Westford, MA (US); Michael A. Furtado, Shrewsbury, MA (US)

(73) Assignee: SimplexGrinnell LP, Westminster, MA (US)

( * ) Notice: Subject to any disclaimer, the term of this patent is extended or adjusted under 35 U.S.C. 154(b) by 423 days.

(21) Appl. No.: 12/483,039

(22) Filed: Jun. 11, 2009

(65) Prior Publication Data

US 2010/0315224 A1 Dec. 16, 2010

(51) Int. Cl.
*G08B 29/00* (2006.01)
*G08B 5/00* (2006.01)
*H05B 39/00* (2006.01)

(52) U.S. Cl. ... 340/514; 340/505; 340/507; 340/538.15; 340/331; 340/641; 340/3.43; 250/200; 250/206; 315/133; 315/134

(58) Field of Classification Search ..... 340/514
See application file for complete search history.

(56) References Cited

U.S. PATENT DOCUMENTS

| | | | | |
|---|---|---|---|---|
| 4,725,818 | A | 2/1988 | Motyka et al. | 340/514 |
| 6,426,697 | B1 | 7/2002 | Capowski et al. | 340/506 |
| 6,737,967 | B2 | 5/2004 | Farley | 340/514 |
| 7,091,855 | B2 | 8/2006 | Barrieau et al. | 340/540 |
| 7,123,165 | B2 * | 10/2006 | Davenport et al. | 340/931 |
| 7,242,292 | B2 | 7/2007 | Berezowski et al. | 340/539.11 |
| 7,400,226 | B2 * | 7/2008 | Barrieau et al. | 340/286.01 |
| 2005/0052927 | A1 | 3/2005 | Barrieau | 365/222 |
| 2005/0128097 | A1 | 6/2005 | Piccolo, III et al. | 340/691.1 |
| 2006/0214811 | A1 | 9/2006 | Barrieau et al. | 340/635 |
| 2007/0263279 | A1 | 11/2007 | Savage, Jr. et al. | 359/345 |
| 2008/0219458 | A1 | 9/2008 | Brooks et al. | 381/57 |

FOREIGN PATENT DOCUMENTS

WO WO 2008/132475 A1 11/2008

* cited by examiner

*Primary Examiner* — Donnie Crosland
(74) *Attorney, Agent, or Firm* — Brinks, Hofer, Gilson & Lione

(57) ABSTRACT

A self-testing notification appliance includes a notification emitter, a verification circuit, and a controller. The notification emitter is operable to output light or light and sound based on a control signal. The verification circuit includes a notification sensor to detect the light or light and sound and generate a verification signal. The controller sends the control signal to the notification emitter and receives information based on the verification signal from the verification circuit. The self-testing notification appliance may be part of a network including a fire control panel and a plurality of additional self-testing notification appliances. The self-testing notification appliances may be assigned addresses on the network.

24 Claims, 10 Drawing Sheets

SELF-TESTING NOTIFICATION APPLIANCE

BACKGROUND

Most single family residences and apartments rely on individual smoke detectors with built-in alarms that can be easily placed in various rooms. Larger buildings, such as apartment or condominium buildings, industrial plants, and schools often require more complex, networked commercial fire alarm systems. These fire alarm systems may include a controller that is centrally located and communicates with numerous alarms and detectors positioned over a large area. The alarm units provide light notification, sound notification, or both to occupants in the vicinity of the alarm. These systems are generally required to be tested periodically to verify that the system is fully operational.

In the conventional commercial system shown in FIG. 1, a fire alarm controller 113 communicates through communication line 109 with an alarm 103. More alarms 103 may be located in other rooms of the building or in other buildings located in the campus or complex.

A testing procedure is typically used to assess whether or not the alarms 103 and controller 113 are properly working. Conventionally, the testing procedure involves at least two people. A first service representative 101 is sent out into the building or complex with a two-way radio 105. A second service representative 100 must stay near the alarm controller 113, which is connected to the alarms 103 via a communication path 109. The second service representative communicates with the first service representative 101 via a second two-way radio 111. The service representatives must perform a manual visual inspection to make sure that each alarm 103 is functioning properly. One way to accomplish this is for the first representative to walk to an alarm 103 to be tested and inform the second representative to activate an alarm condition at alarm 103, possibly activating other alarms outside the perception of the first representative. Once the alarm 103 is activated, the first representative must communicate his observations back to the second service representative. To test the entire system, the process must be repeated for each alarm 103 in the system.

The walk through test required at the installation and regular maintenance of fire alarm systems is time consuming, costly and potentially disruptive particularly if the alarm 103 has a sound notification component. Further, because it is prone to human error, the walk through test is unreliable. A system is needed that requires less human involvement, less time to test alarm devices, is less disruptive, and is more reliable.

SUMMARY OF INVENTION

A self-testing notification appliance includes a notification emitter, a verification circuit, and a controller. The notification emitter includes a visual notification (e.g., strobe) and may optionally also include aural notification (e.g., speaker or horn). The notification emitter may output visual notification based on a control signal. The visual notification is indicative of an alarm event. The verification circuit may include one or more notification sensors to detect the visual notification and generate a verification signal. The controller may initiate the test and/or receive input to test the notification appliance (such as receiving input from a remote central controller or from an input device, such as a switch) on the notification appliance, as discussed in more detail below. The controller may then send a control signal to instruct the notification emitter to conduct a test, and receive information indicating the result of the test, such as the verification signal from the verification circuit.

In one application of a self-testing notification appliance, the verification circuit may determine the brightness or intensity of the light. For example, the notification appliance may operate the strobe in an alarm mode (i.e., generating an output brightness/intensity of the strobe that is the same or approximately the same as the output brightness/intensity that is required or rated for notification of an alarm event). The verification circuit may then provide information on the brightness or intensity of the light in order to determine whether the strobe, during test operation, output brightness/intensity that is required or rated for notification of an alarm event. If the brightness/intensity of the strobe is less than that required or rated for notification of an alarm event, the controller may adjust the brightness and/or intensity of the strobe based on the verification signal so that the output of the strobe is at least as much as required for notification of an alarm event.

In one embodiment, the self-testing notification appliance may be part of a network including a fire alarm control panel and a plurality of additional self-testing notification appliances. The self-testing notification appliances may be assigned addresses on the network. The fire control panel may send control signals to the notification appliance based on the network address. The fire control panel may receive test information from the notification appliance and compile that information, along with test information from other self-testing notification appliances.

In one embodiment, the self-testing notification appliance is not addressable. A fire alarm control panel may be networked with a plurality of non-addressable notification appliances on a common circuit. A control signal from the fire alarm control panel controls all notification appliances on the common circuit to output light. A verification circuit on the notification appliance detects whether the light intensity is above a threshold level. If the light intensity is not above a threshold level, the notification appliance will interrupt a signal sent by the fire alarm control panel. The interruption will indicate to the fire alarm control panel that a failure has occurred.

The present invention is defined by the following claims, and nothing in this section should be taken as a limitation on those claims. The preferred embodiments will now be described with reference to the attached drawings.

DETAILED DESCRIPTION

The present embodiments relate to self-testing notification appliances or devices. Notification appliances may include a visual alarm (strobe) and may additionally include an audible alarm (horn or speaker). A notification appliance is self-testing when it is capable of performing a test through instruction from a controller or control panel without requiring a person to be physically within audible range or visual range of the notification appliance to verify the proper operation of the appliance. This is accomplished by including a verification circuit in the notification appliance that is capable of detecting the visible or audible notification.

The controller instructs the notification appliance to illuminate an alarm, and a verification circuit detects the alarm. The verification circuit detects the alarm by a sensor and circuitry located in the appliance. The notification sensor could be a photodetector capable of detecting a visual alarm. Alternatively, the notification sensor may include both a photodetector capable of detecting a visual alarm and a microphone capable of detecting an audible alarm. The self-testing notification appliance may be directly connected to a controller or control panel or it may be connected to a network for communication with the controller or control panel. The connection may be wired or wireless. The self-testing notification appliance may be individually addressable and communicate independently with the control panel or the self-testing notification appliance may be wired along with a group of notification appliances on a circuit (non-addressable).

Figure 1:
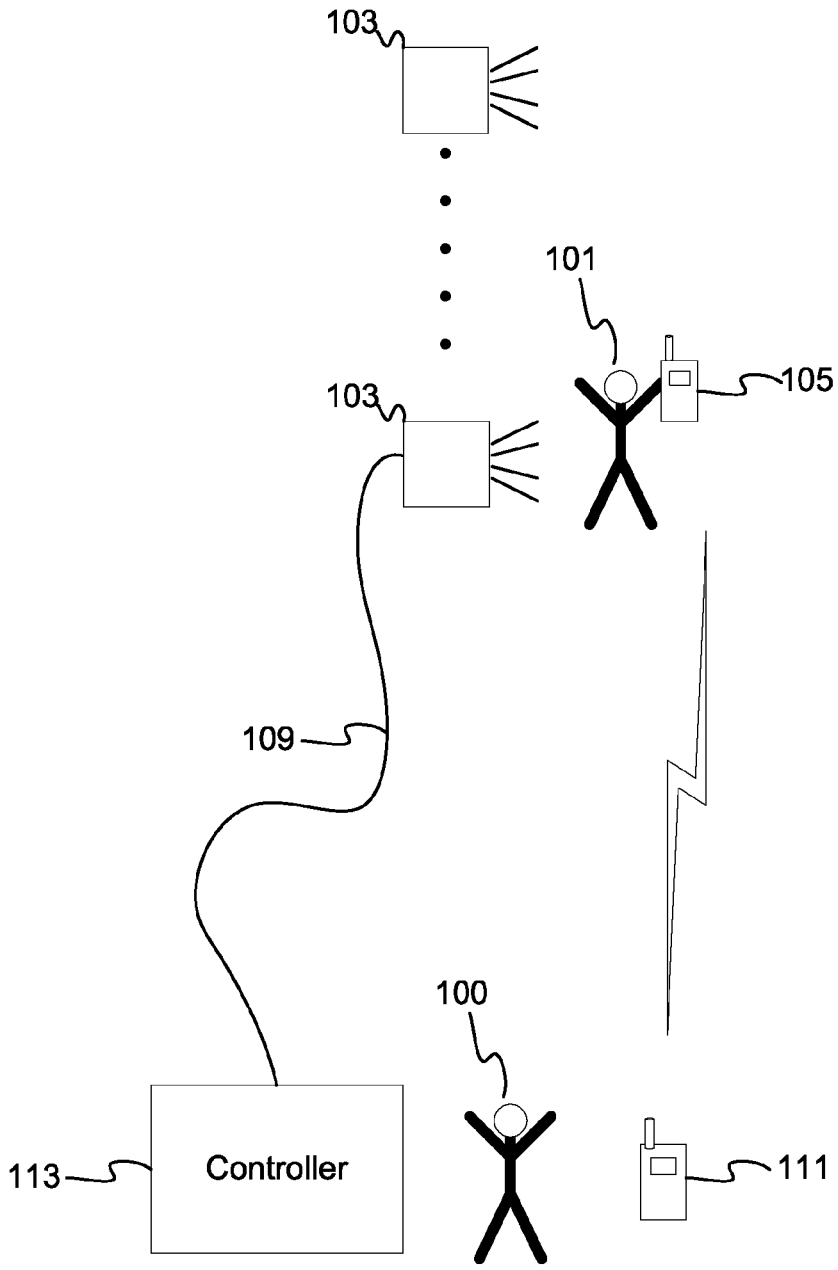
FIG. 1 PRIOR ART
FIG. 1 illustrates an example of a process to assess if a conventional fire alarm system is properly working.
Figure 2:
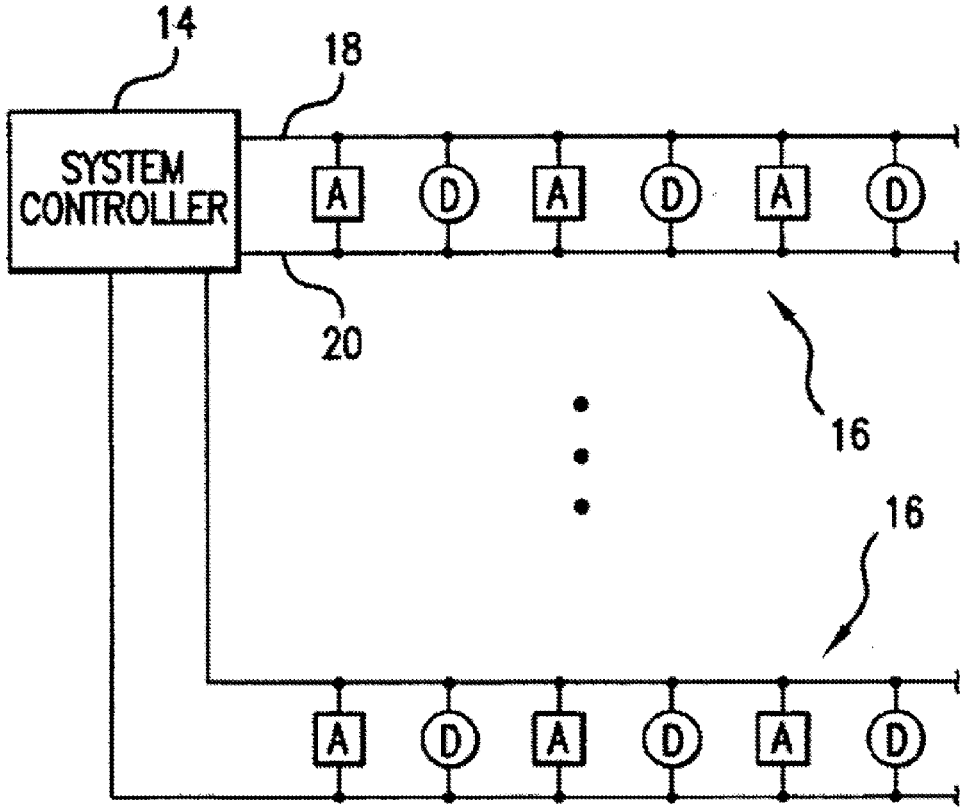
FIG. 2 illustrates a notification system according to an embodiment.

A notification system is illustrated in FIG. 2. The system includes a network 16, having alarm condition detectors D and alarm notification appliances A. A system controller or fire alarm control panel (FACP) 14 monitors the detectors D. Detectors D may include, but are not limited to, fire detectors, smoke detectors, radiation detectors, heat detectors, carbon monoxide detectors, ozone detectors or other gas detectors. Detectors D automatically provide an indication of an alarm condition to the system controller 14. Although not shown, manual alarm triggers may also provide an indication of an alarm condition to the system controller 14. Manual alarm triggers include a pull device, push button triggers, and glass break triggers.

As an alternative to the notification system illustrated in FIG. 2, the detectors D and notification appliances A may communicate with FACP 14 through separate circuits. The detectors D may have power signal requirements and communication signal requirements much different than those of notification appliances A. For example in one embodiment, detectors D may require one-way communication, while notification appliances A may require two-way communication. In another example, notification appliances A may require more power, and accordingly a heavier gauge power cable, than the detectors D. In either of these examples, it would be advantageous for the detectors D and notification appliances A to be networked by separate circuits.

When an alarm condition is sensed, the system controller 14 signals the alarm to the appropriate notification appliances through one or more networks 16. Although other configurations are available, in the network 16 shown, the notification appliances are coupled across a pair of power lines 18 and 20 that also carry communications between the system controller 14 and the detectors D and notification appliances A. Network 16 carries two-way communication between the system controller 14 and the notification appliances A.

The communication signal can, for example, be multiplexed onto the device's power line—this provides the added benefit that it saves the cost of additional wiring to devices. See for example, U.S. Pat. No. 6,426,697, incorporated by reference herein in its entirety. Alternatively, the communication line to the device may be separate from the power line. The communications channel may comprise a wired link or a wireless link using, for example, radio, an infrared link, or a fiber optic link.

Notification appliances A and detectors D are addressable on the network 16. The system controller 14 may be configured to provide addresses to the notification appliances A and detectors D. The addresses may be non-duplicative, in which each notification appliance A and detector D receives a unique addresses. Alternatively, the addresses may be assigned in groups. The address for each of the notification appliances A may be set by a signal download from an external programming tool provided at system controller 14 or by manually configuring switches located on or internal to the device. A label may be affixed to the notification appliance to indicate the address that has been assigned to that notification appliance.

Figure 3:
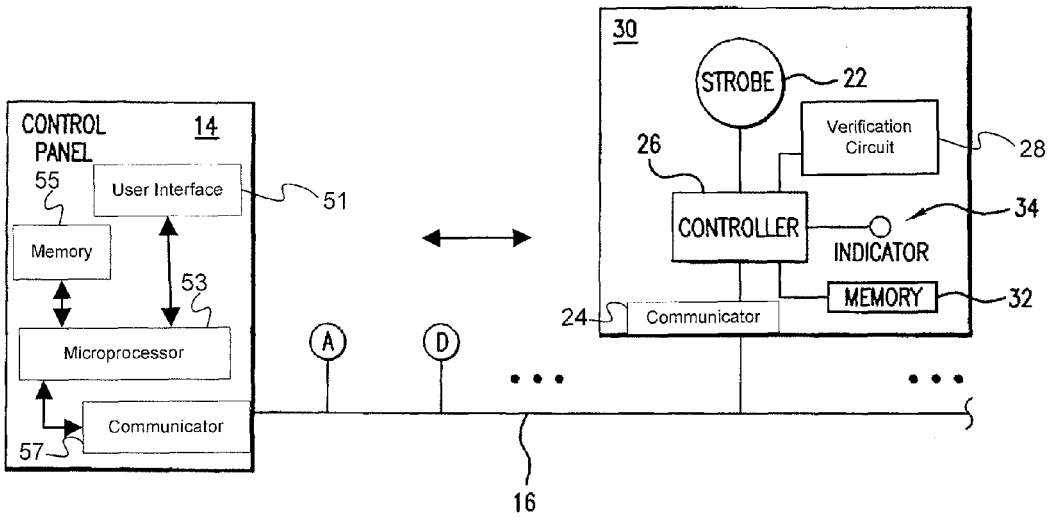
FIG. 3 illustrates a schematic diagram of the notification system of FIG. 2 including an exemplary notification appliance.

FIG. 3 is a schematic diagram of the system of FIG. 2. For simplicity, the two-line network of FIG. 2 is shown with a single line 16 which is used to logically represent a connection in general which may be wired with any number of lines or may be a wireless link. The control panel 14 includes user interface 51, memory 55, microprocessor 53, and communicator 57.

Microprocessor 53 manages the control panel 14 and alarm system. Microprocessor 53 receives commands from instructions stored in memory 55 and receives commands from user interface 51. User interface 51 is a keyboard or other input device configured to allow a user or a computer to enter commands to the control panel 14. Microprocessor 53 may also receive commands from a removable medium. Memory 55 may also store the testing procedure or testing schedule performed by the control panel 14 in testing the verification circuits and the notification appliances.

The control panel 14 may be embodied on a personal computer, and the functions of the control panel may also be embodied on software. The testing and verification process can be carried out automatically by the control panel 14 or through instruction from the user by way of the user interface 51. Control panel 14 may also include a modem or network interface card configured to communicate with an intranet computer network or with the Internet. The testing schedule performed by the verification circuit could be downloaded by control panel over the intranet computer network or the internet.

Communicator 57 is configured to send and receive commands and/or data from network 16. Communicator 57 includes a network interface as well as the decoding circuitry and amplification circuitry necessary for communication on network 16.

FIG. 3 further illustrates strobe device 30 as an example of a notification appliance A. Strobe device 30 includes a controller 26, communicator or network interface 24, and verification circuit 28. Strobe device 30 includes strobe 22 which may be embodied as a Xenon flashtube or light emitting diode (LED). The notification appliance optionally includes memory 32 and indicator 34. Although the implementation shown in FIG. 3 includes only strobe 22, the notification emitter may additionally include audio devices or sounders such as horns, bells, or speakers.

The light from the notification appliance provides a visual notification to people in the vicinity of the notification appliance. The sensory notification may be determined by regulations for notifying of an alarm event. For example, regulations dictate the intensity or brightness of the sensory notification of a strobe.

Strobe device 30 connects to the network 16 via a communicator 24. Communicator 24 is configured to send and receive commands and/or data from network 16. Communicator 24 includes a network interface as well as the decoding circuitry and amplification circuitry necessary for communication on network 16. Controller 26 receives commands from and sends data to the control panel 14 by way of communicator 24.

Controller 26 may be embodied as a microcontroller, an integrated circuit, or any hardwired logic. When commanded by controller 26, a driving circuit supplies power and a trigger signal to illuminate strobe 22. The driving circuit may include a chargeable member, such as a high voltage capacitor, to supply power to strobe 22. Memory 32 stores instructions for controller 26 and may be configured to store a testing schedule, as addressed below.

The controller 26 may generate a control signal to send to the strobe 22. The strobe 22 may receive the control signal and may output light at the intensity/brightness the same as (or similar to) the intensity/brightness as required by regulations for notifying occupants of a premises of an alarm event. The controller 26 may generate the control signal sent to strobe 22 in response to a command sent from control panel 14. In turn, the command sent from the control panel may be generated in response to input to the networked computer from the user or in response to a predetermined schedule of testing stored in memory 55 of the control panel 14. The controller 26 may also generate the control signal in response to an instruction input from the user, such as an instruction wirelessly communicated by the user or communicated via an input panel on the strobe device 30. Or, the controller 26 may generate the control signal based on a predefined testing schedule that may be resident locally at the strobe device 30 in memory 32. The verification circuit 28 receives commands from controller 26 to detect the operation of the strobe 22. The command from the controller 26 to verification circuit 28 may also include a test duration signal. From the test duration signal, the verification circuit 28 is configured to perform detection of strobe 22 for a predetermined time period.

Figure 4:
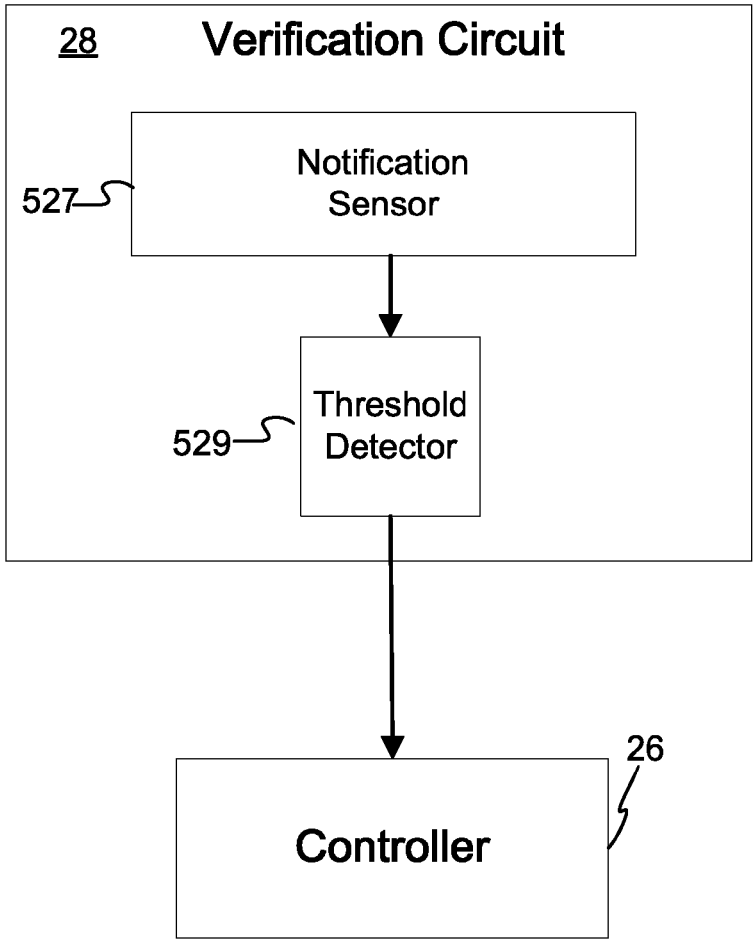
FIG. 4 illustrates one implementation of a verification circuit of the notification appliance.

FIG. 4 illustrates a detailed view of the verification circuit 28, including a notification sensor 527 and a threshold detector 529. The threshold detector 529 is in communication with controller 26.

Notification sensor 527 includes a photodetector, such as a photodiode. The photodiode is a light sensing device that is configured to receive light from strobe 22, sense the light at discrete frequencies or one or more frequency ranges, and output a signal indicative of the amount of light sensed. The frequency ranges may be selected such that the notification sensor senses all types of visible light.

When the notification appliance additionally includes a horn or speaker, notification sensor 527 may additionally includes a microphone or other sound pressure level measurement device. The microphone is configured to receive the output of the horn or speaker and output a signal indicative of the sound received. The verification circuit may also be configured with filters so that the microphone outputs the signal only for input sounds corresponding to a defined range of frequencies. Other types of sensors may be used as long as the sensor is able to detect the notification emitted by the appliance.

A reflector or shield may be used to prevent the notification sensor 527 from falsely detecting light from sources other than strobe 22. The other sources of light may cause interference to the system and should be avoided. The other sources of light may include ambient light from sunlight or lighting in the building. Even though the intensity of the light emitted from strobe 22 will normally be orders of magnitude greater than the intensity of surrounding light, the reflector or shield will further minimize the effects of surrounding light.

The threshold detector 529 receives the output of the notification sensor 527 and functions as a comparator. Threshold detector 529 may include a variably set threshold value. The output of the threshold detector 529 is sent to the controller 26. The sources of light that may potentially cause interference will generally be low enough in intensity during activation of the device that the notification sensor 527 will output a value lower than the threshold value of threshold detector 529.

In addition, ambient light will generally cause a constant level of output from the notification sensor 527. Strobe 22, however, will cause a sharp spike in the output of the notification sensor 527. By setting the threshold value above the ambient light levels but well below the typical spike caused by the strobe light, the verification circuit avoids indicating false positives in the testing procedure.

Figure 5:
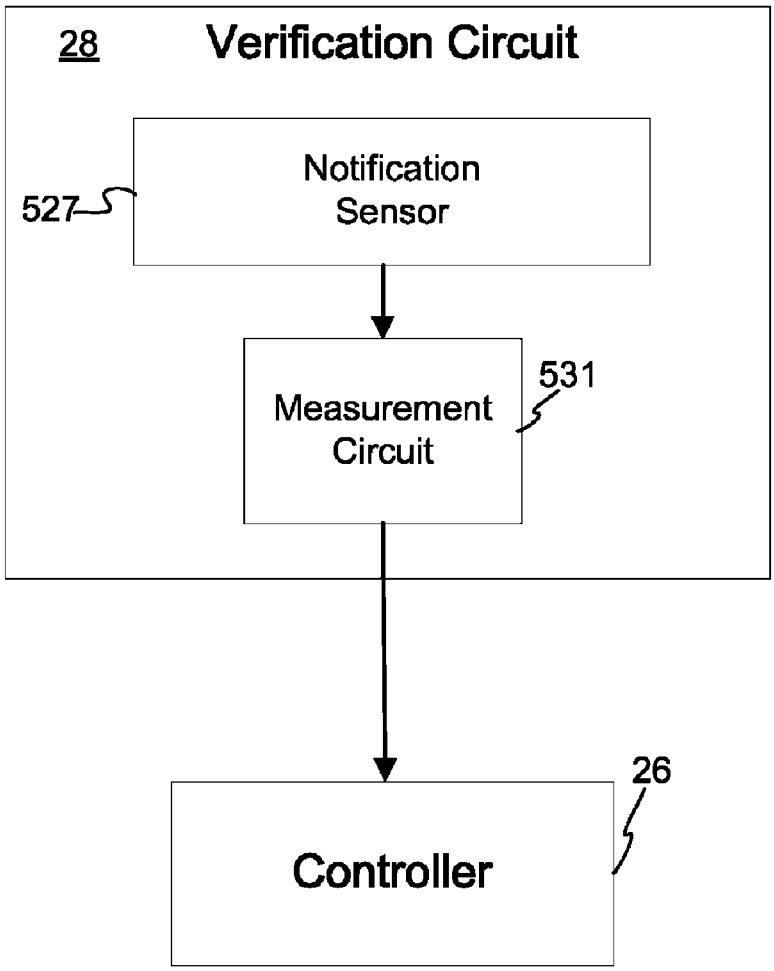
FIG. 5 illustrates another implementation of a verification circuit of the notification appliance.

FIG. 5 illustrates another example of verification circuit 28. In this example, verification circuit 28 includes a measurement circuit 531 and notification sensor 527. Measurement circuit 531 receives the output of the notification sensor 527, converts the signal to a scaled value, and sends a measurement signal including the scaled value to the controller 26. The measurement circuit 531 may include an analog to digital converter (ADC) and a peak and hold circuit to send, as the measurement signal, a digital representation of the output of the notification sensor 527 to the controller 26. Controller 26 may perform a threshold comparison to determine if the output of the notification sensor 527 is in an acceptable range as determined by software settings within the controller 26. Alternatively, controller 26 may make no comparison and simply send the data to the alarm panel for analysis there.

The signal from the verification circuit 28 to controller 26, referred to as the verification signal, may include the threshold signal or the measurement signal.

Figure 6:
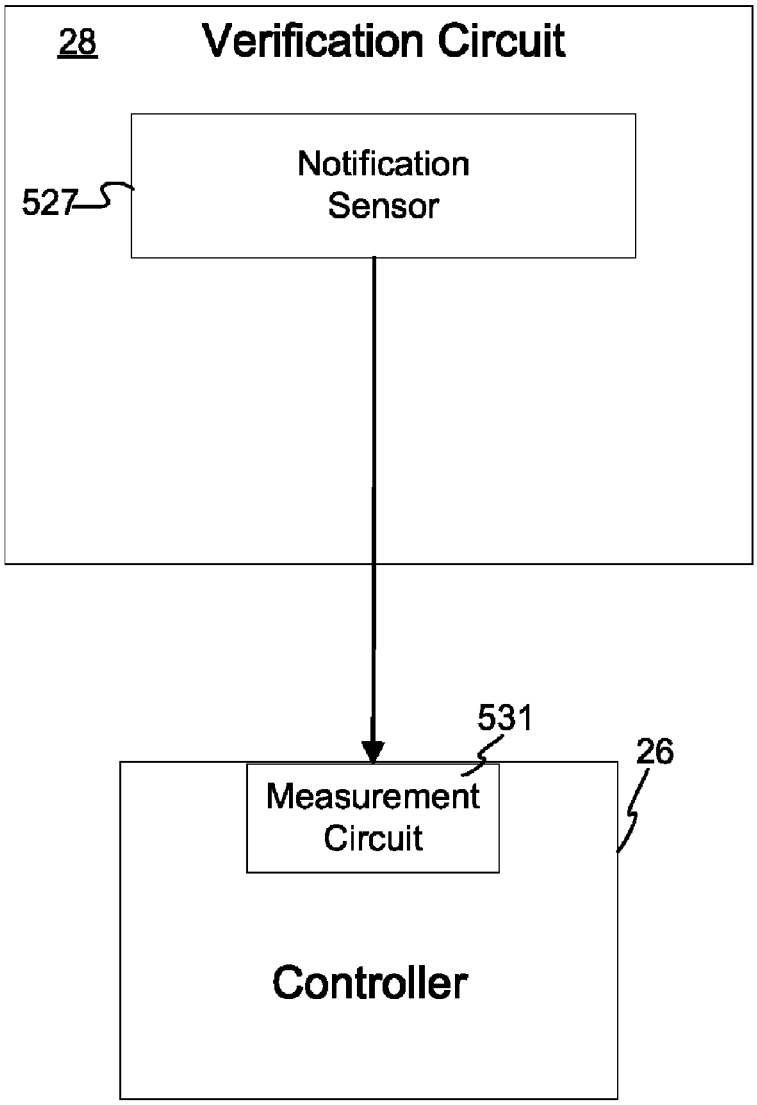
FIG. 6 illustrates yet another implementation of a verification circuit of the notification appliance.

FIG. 6 illustrates yet another example of verification circuit 28. In this example the function of measurement circuit 531 is implemented by controller 26. The controller 26 receives the direct output of the notification sensor 527.

In the examples of FIG. 5 and FIG. 6, the measurement signal may be used to calibrate strobe 22. The level of the measurement signal as determined by the measurement circuit 531 or by controller 26 indicates the intensity of the strobe 22. Over time, the intensity of strobe 22 may deteriorate. Controller 26 is configured to determine the level of intensity of strobe 22 based on the measurement signal. The controller 26 may compare the level of intensity of strobe 22 with a rated intensity stored in memory 32. Based on this comparison, controller 26 may adjust the control signal sent to the driving circuit of strobe 22 to increase or decrease the output intensity or brightness of the light so that the strobe 22 outputs light at approximately the rated intensity. A system adapted to select the intensity of a strobe is shown and described by U.S. Patent Application Publication No. US 2005/0128097, which is hereby incorporated by reference in its entirety.

Likewise, in the case of a notification appliance with strobe 22 and a horn or speaker, the notification sensor 527 outputs a signal indicative of the intensity of the sound. Measurement circuit 531 or controller 26 is configured to determine the level of intensity of the sound. The controller 26 may compare the intensity of the sound with a rated intensity stored in memory 32, and adjust the control signal sent to the driving circuit accordingly. A system adapted to select the intensity of a speaker is shown and described by U.S. patent application No. US 2008/0219458, which is hereby incorporated by reference in its entirety.

Figure 7:
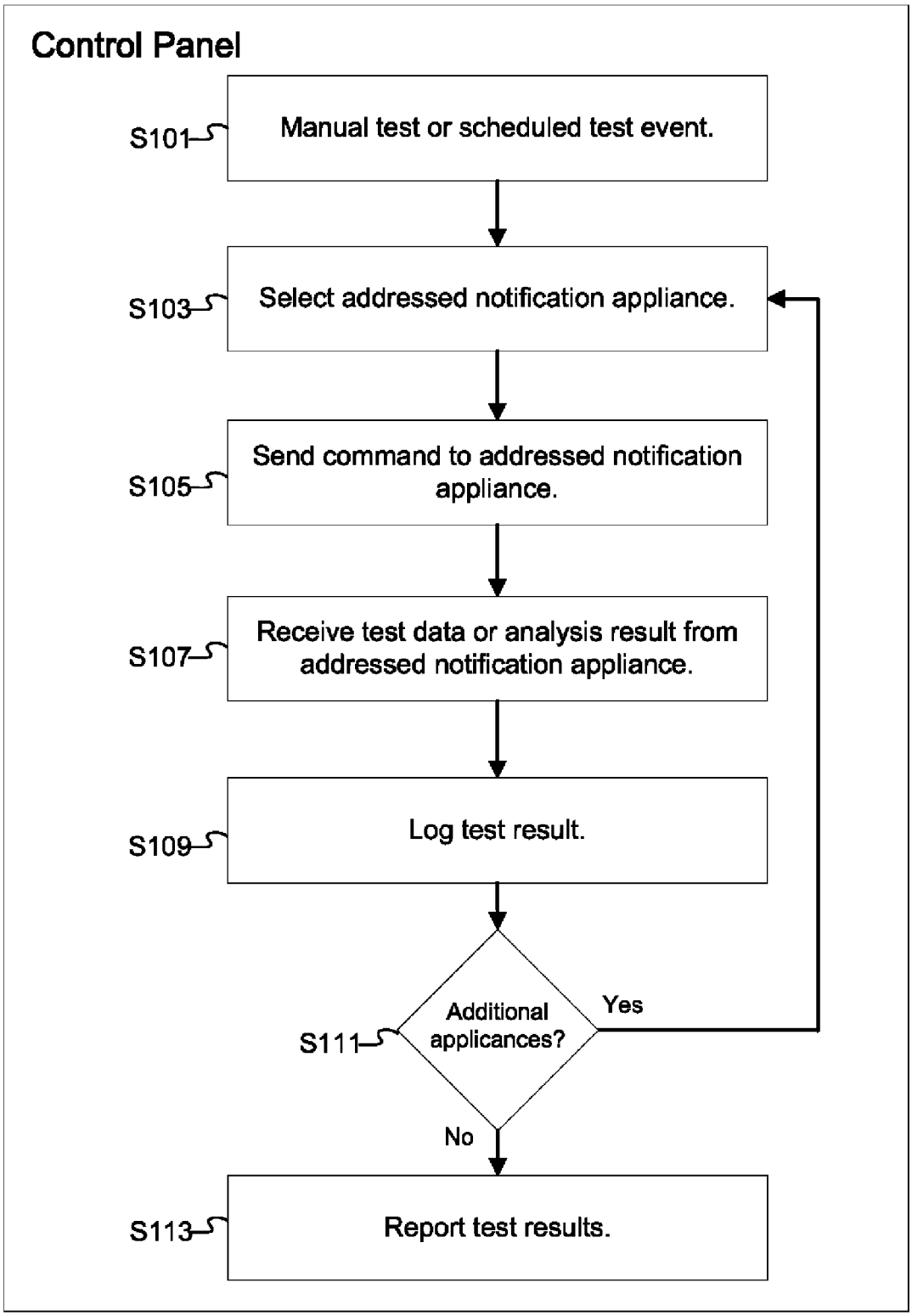
FIG. 7 illustrates a testing procedure performed by the system control panel.

FIG. 7 illustrates the testing procedure performed at control panel 14. At block S101, the control panel 14 receives a command from a user or from a predetermined testing schedule stored in memory 55. Alternatively, the testing schedule may be stored in memory 32 at the notification appliance 30. At block S103, the control panel 14 selects an addressed notification appliance to perform the test. The control panel 14 may sequence the testing procedure among the notification appliances or they may all be tested at the same time or in groups. At block S105, the control panel 14 sends the testing command to the first addressed notification appliance (or group of notification appliances) in the testing schedule. At block S107, the control panel 14 receives information back from the notification appliance. The information may either be the test data, at which point the control panel analyzes the data, or the result of an analysis performed by the measurement circuit 531 and controller 26.

At block S109, the control panel 14 logs the test result. At block S111, the control panel 14 checks the testing schedule to determine if tests of additional notification appliances are to be run. If no additional tests are to be run, the control panel 14, at block S113 reports the cumulative test results. The test results may be displayed to the user via user interface 31, stored in memory 55, or transmitted to an external device, such as a printer. Additionally, the test results or the list of test results may be emailed or otherwise electronically transmitted to a user or customer. If additional tests are to be run, the control panel returns to block S 103 and repeats the procedure until no additional tests are remaining.

Figure 8:
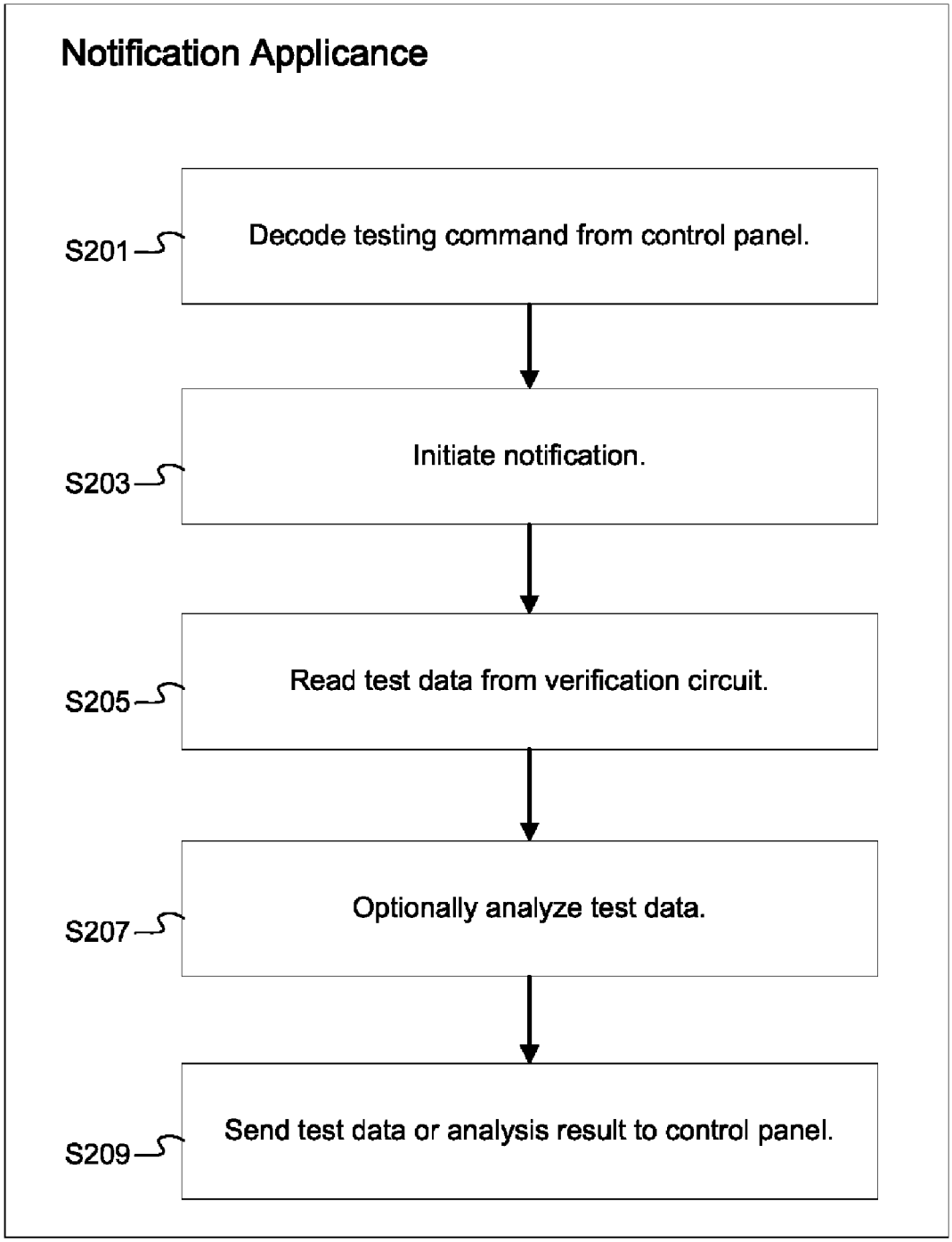
FIG. 8 illustrates a testing procedure performed by the notification appliance.

FIG. 8 illustrates the testing procedure performed by controller 26 in the notification appliance. At block S201, controller 26 decodes the testing command from the control panel 14. At block S203, the controller 26 initiates the notification from either strobe 22 or an audible device or both if so equipped. At block S205, the controller 26 reads the test data from the verification circuit 28. Optionally, the controller 26 may analyze the test data, as indicated by block S207. At block S209, information is sent to the control panel 14. The information is the test data, if S207 is omitted, and the information is the analysis results, if S207 is not omitted.

In an embodiment in which controller 26 analyzes the test data, an indicator 34, as shown in FIG. 3 indicates the result of the analysis of the test data. The indicator receives an indicator signal from controller 26. For example, an unlit light emitting diode (LED) may indicate that the most recent test was successful and a lit LED may indicate that the most recent test was unsuccessful.

Figure 9:
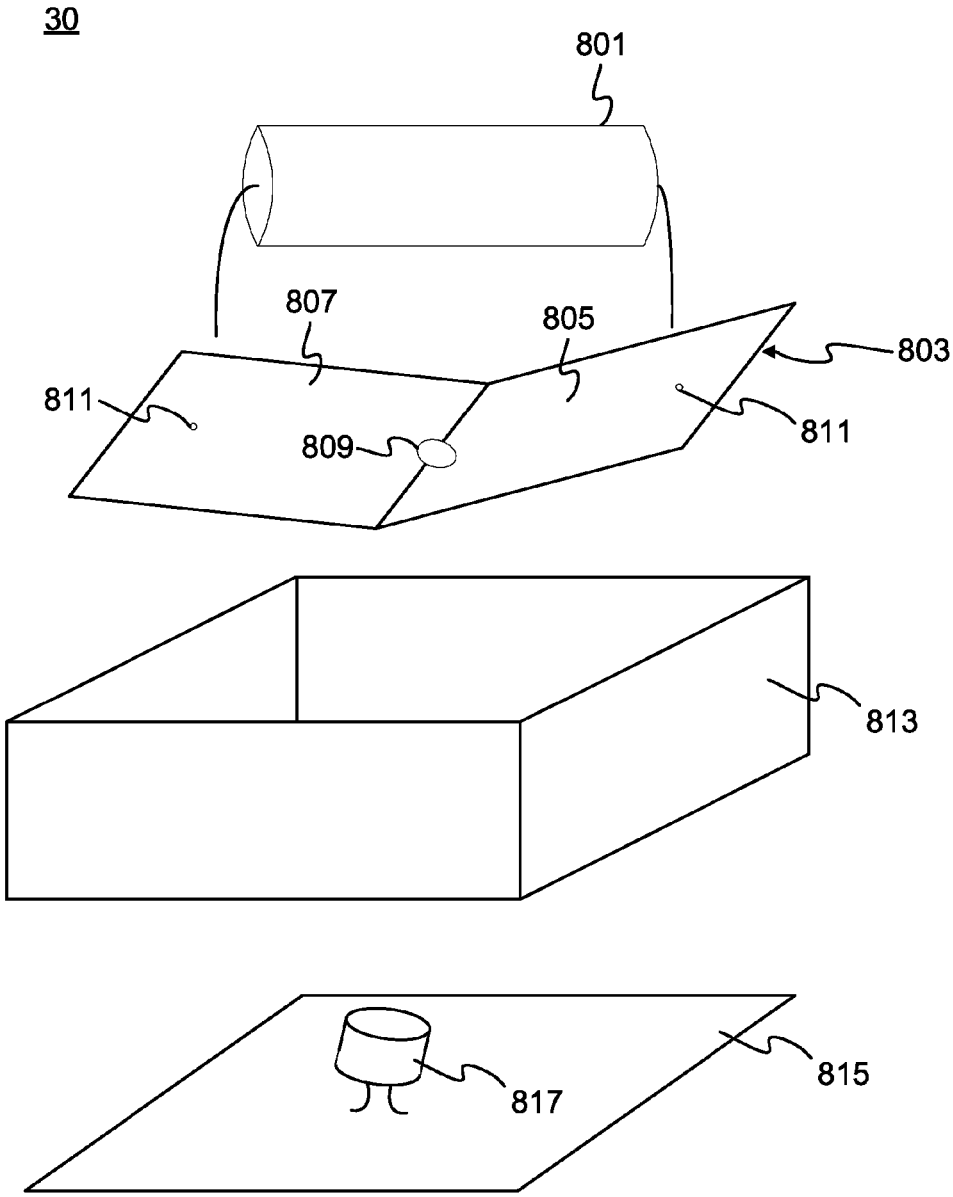
FIG. 9 illustrates an exploded view the notification appliance.

FIG. 9 illustrates an exploded view of a notification appliance 800 including a strobe as light emitting device 801, a reflector 803, a housing 813, and a circuit 815. Light emitting device 801 may be a Xenon flashtube, a strobe light, or a light emitting diode (LED). Circuit 815 includes a driving circuit, a verification circuit, and a controller similar to previously discussed embodiments. The driving circuit may be isolated from the verification circuit to reduce false test results.

The verification circuit portion of circuit 815 includes photodiode 817 Photodiode 817 may be implemented as any type of photodetector. Examples of suitable photodetectors include optical detectors, photoresistors, photovoltaic, phototransistors, charge-coupled devices (CCD), or reverse biased LEDs. Light pipes may be used to further reduce false testing by providing additional shielding or preferred placement of the photodetector relative to the strobe and/or shield.

The driving circuit portion of circuit 815 includes a chargeable member, which may be implemented as a high voltage capacitor. Exemplary driving circuits are shown and described by U.S. Patent Application Publication No. US 2007/0263279, which is hereby incorporated by reference in its entirety.

Housing 813 is formed to encase the notification appliance 800. Housing 813 may be formed of plastic, glass, resin, metal, or any suitable material. Materials that are resistant to heat may be advantageous or required by applicable regulations.

Reflector 803 is mounted between the light emitting device 801 and the verification circuit for the purposes of focusing the emitted light into the room at areas that enhance notification, while, at the same time, allowing light from the light emitting device 801 to reach photodiode 817. Further, the reflector reduces the ambient light that reaches the photodiode 817. One exemplary design includes an angled reflective sheet including an opening 809. The angled sheet forms a first plane 805 and second plane 807. Reflector 803 may be a polished metal, such as stainless steel. Reflector 803 may be formed from plastic, paper, resin, or cardboard coated or painted on one or both sides with a reflective paint or other substance. As discussed above, ambient light caused by sunlight or light fixtures may be present in the location where notification appliance 800 has been installed. Reflector 803 reduces the effects of ambient light.

Reflector 803 further includes holes 811 to pass the leads of the light emitting device 801 to the driving portion of circuit 815. Opening 809 allows a controlled portion of light to pass through the reflector 803 to be detected by photodiode 817. In this manner, the amount of ambient light reaching the photodetector 817 is reduced.

Besides ambient light, interference may, in some circumstances, be caused by electromagnetic fields (EMF). The driving circuit utilizes high voltages, and the resulting EMF may cause voltage disturbances in the output of the photodetector 817. In this case, light pipes may be utilized to further distance and isolate the photodetector 817 from the driving circuit portion of circuit 815. Alternatively, or in addition to light pipes, digital logic, filtering, or an analog circuit the false positives caused by the EMF can be distinguished from the intended output signal from a sensory notification from the notification emitter.

Figure 10:
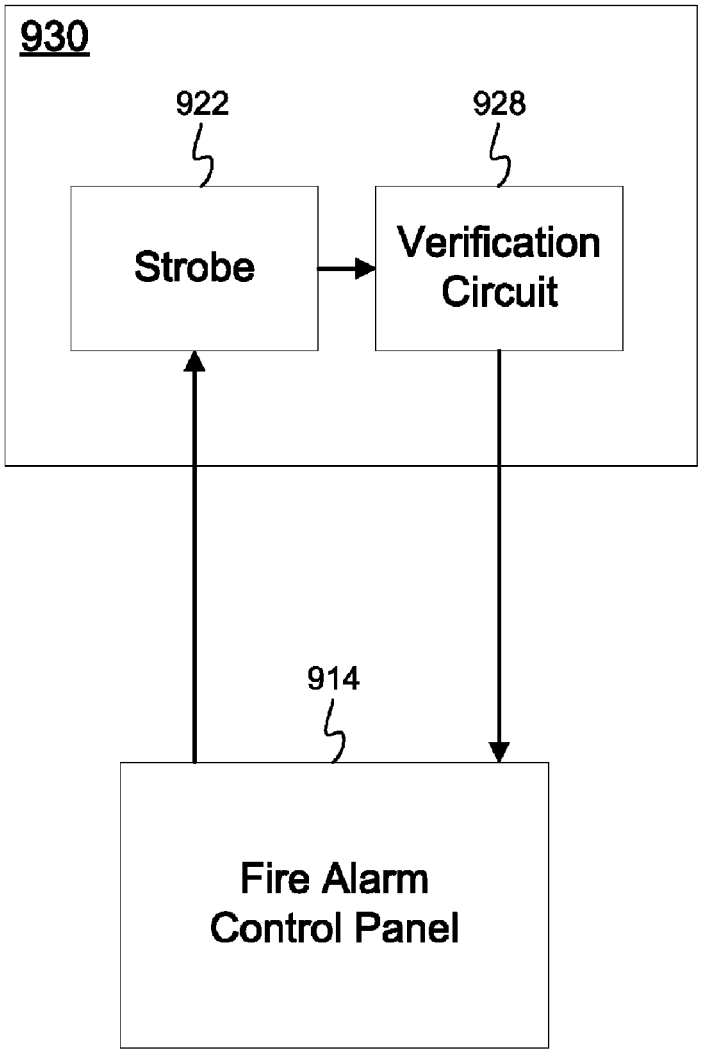
FIG. 10 illustrates a notification system including non-addressable notification appliances.

Notification appliance 800 of FIG. 9 may be non-addressable. FIG. 10 illustrates an exemplary notification system implementing a non-addressable notification appliance 930. One or more non-addressable notification appliances may be connected to fire alarm control panel 914 on a circuit. The non-addressable notification appliance includes a strobe 922 and a verification circuit 928. The strobe 922 of the non-addressable notification appliance emits light from power supplied by the fire alarm control panel. The fire alarm control panel 914 may be implemented in a similar manner and using similar components as fire alarm control panel 14, shown in FIG. 3.

Non-addressable notification appliances do not necessarily include a controller. The fire alarm control panel 914 controls all notification appliances on the circuit together, and there is not two-way communication between the fire alarm control panel and an individual notification appliance. Fire alarm control panel 914 is coupled to non-addressable notification appliance 930 via a single pair of wires that provides power to the notification device. Alternatively, two or more non-addressable notification devices may be coupled to the fire alarm control panel 914 using a single pair of wires.

A control signal is multiplexed onto the power signal. A strobe 922 outputs an amount of light based on the control signal. A verification circuit 928 is activated based on the control signal. As discussed in the previous embodiments, the verification circuit 928 includes a photodetector. When the control signal instructs the strobe 922 to output an amount of light and the photodetector detects that the intensity of the light is below the threshold, the verification circuit will interrupt the power signal. The interruption appears as an open circuit to the fire control panel 914.

In one embodiment, when two or more non-addressable notification appliances 930 are coupled to the fire alarm control panel 914 using a common notification appliance circuit, the fire control panel 914 cannot distinguish which appliance caused the open circuit. The open circuit may indicate the failure of one or more strobes on the common notification appliance circuit. Alternatively, the non-addressable notification appliances 930 may be coupled to the fire alarm control panel 914 on individual circuits.

The fire alarm control panel 914 may log the failure of the one or more strobes in a memory. Further, the fire alarm control panel 914 may print, display, or email the failure of the one or more strobes.

Additionally, the features described above with respect to addressable notification appliances may be applied to non-addressable notification appliance where functions performed by the controller of the addressable notification appliance are performed by the fire alarm control panel 914.

Although specific embodiments of the invention have been described and illustrated, the invention is not to be limited to the specific forms or arrangements of parts so described and illustrated. The scope of the invention is to be defined by the claims appended hereto and their equivalents. It is intended that the foregoing detailed description be understood as an illustration of selected forms that the invention can take and not as a definition of the invention. It is only the following claims, including all equivalents that are intended to define the scope of this invention.

What is claimed is:

1. A self-testing notification appliance, comprising:

a notification emitter operable to output a visual fire alarm in response to a control signal;

a verification circuit including a notification sensor configured to detect at least a part of the visual fire alarm and configured to generate a verification signal; and a controller operable to send the control signal to the notification emitter and to receive test information based on the verification signal.

2. The self-testing notification appliance of claim 1, wherein the controller receives instructions to generate the control signal from an external control panel.

3. The self-testing notification appliance of claim 1, wherein the verification circuit further comprises a threshold detector configured to compare the verification signal with a threshold value and communicate a result of the comparison to the controller.

4. The self-testing notification appliance of claim 3, wherein the verification circuit further comprises a measurement circuit to generate a digital representation of the verification signal and communicate the digital representation as the test information to the controller.

5. The self-testing notification appliance of claim 1, wherein the visual fire alarm is a light, the appliance further comprising:

a reflector mounted between the notification emitter and the verification circuit; and an opening located in the reflector to allow the light to pass through the reflector and reach the notification sensor.

6. The self-testing notification appliance of claim 1, wherein the notification emitter comprises a strobe light or flashtube and the notification sensor comprises a photodetector.

7. The self-testing notification appliance of claim 1, wherein the notification emitter comprises a light emitting diode (LED) and the notification sensor comprises a photodetector.

8. The self-testing notification appliance of claim 1, wherein the controller is configured to adjust the brightness of the notification emitter based on the verification signal.

9. The self-testing notification appliance of claim 1, wherein the controller is configured to instruct the verification circuit to detect the visual fire alarm for a selectable time period.

10. The self-testing notification appliance of claim 1, wherein the notification appliance is addressable on a network in communication with a fire control panel.

11. A method of testing a notification appliance including a notification emitter, a verification circuit, and a controller, the method comprising:

emitting a visual fire alarm from the notification emitter based on a control signal from the controller;

detecting at least a part of the visual fire alarm with a notification sensor included in the verification circuit; and sending a verification signal indicative of the detection to the controller.

12. The method of claim 11, further comprising:

sending a test result indicative of the detection from the controller to an external control panel;

logging the test result and an address of the notification appliance in a memory; and outputting the results from the external control panel.

13. The method of claim 12, wherein the outputting comprises printing the test result, displaying the test result, or sending an electronically transmitted message including the test result.

14. The method of claim 11, further comprising:

comparing the verification signal to a threshold value.

15. The method of claim 11, wherein detecting the visual fire alarm with the notification sensor further comprises:

generating a digital representation of the output of the notification sensor as the verification signal.

16. The method of claim 11, wherein the notification emitter comprises a strobe light or a flashtube and the notification sensor comprises a photodetector.

17. The method of claim 11, wherein the controller is configured to adjust the brightness of the notification emitter based on the verification signal.

18. The method of claim 11, further comprising:

assigning a network address to the notification appliance.

19. A notification system including a fire alarm control panel and a plurality of self-testing notification appliances, the notification system comprising:

a controller configured to send a power signal and a control signal to a notification appliance of the plurality of self-testing notification appliances; wherein each of the plurality of self-testing notification appliances comprises:

a strobe configured to output an amount of light based on the control signal; and a verification circuit including a photodiode configured to detect the amount of light from the strobe based on the control signal, the verification circuit configured to interrupt the power signal if the amount of light from the strobe is below a threshold.

20. The notification system of claim 19, wherein the controller is configured to identify the interruption of the power signal as a failure of the strobe.

21. The notification system of claim 20, wherein the controller is configured to log the failure of the strobe in a memory.

22. The notification system of claim 20, wherein the fire alarm control panel controller is further configured to print, display, or email the failure.

23. The notification system of claim 19, wherein the fire alarm control panel sends the control signal to the plurality of self-testing notification appliances by way of a common circuit.

24. A self-testing notification appliance comprising:

a strobe configured to receive a power signal from an external device and output an amount of light based on a control signal received from the external device; and a verification circuit including a photodiode configured to detect the amount of light from the strobe based on the control signal, the verification circuit configured to interrupt the power signal if the amount of light from the strobe is below a threshold.

* * * * *